US007273348B2

(12) United States Patent
Amirtharajah et al.

(10) Patent No.: US 7,273,348 B2
(45) Date of Patent: Sep. 25, 2007

(54) METHOD AND ASSEMBLY FOR ALIGNING A TURBINE

(75) Inventors: Jeyaruban Amirtharajah, Niskayuna, NY (US); Thomas W. Swart, Niskayuna, NY (US); Michael Hamlin, Burnt Hills, NY (US); Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 106 days.

(21) Appl. No.: 11/234,048

(22) Filed: Sep. 23, 2005

(65) Prior Publication Data

US 2007/0071600 A1 Mar. 29, 2007

(51) Int. Cl.
*F01D 25/24* (2006.01)

(52) U.S. Cl. ..... 415/214.1; 415/108; 29/889.2

(58) Field of Classification Search ..... 415/1, 415/108, 213.1, 214.1, 229, 230; 29/889.2
See application file for complete search history.

(56) References Cited

U.S. PATENT DOCUMENTS 3,754,833 A * 8/1973 Remberg ..... 415/108
4,537,560 A 8/1985 Emeterio et al.
5,123,812 A 6/1992 Groenendaal, Jr. et al.
5,627,761 A 5/1997 Pollard
5,779,442 A 7/1998 Sexton et al.
5,913,658 A 6/1999 Sexton et al.
6,079,943 A 6/2000 Sexton et al.
6,082,963 A 7/2000 Sexton et al.
6,224,332 B1 5/2001 Leach et al.
6,402,468 B1 * 6/2002 Florin et al. ..... 415/214.1
6,839,979 B1 1/2005 Godbole et al.

* cited by examiner

*Primary Examiner*—Edward K. Look
*Assistant Examiner*—Dwayne J White
(74) *Attorney, Agent, or Firm*—Armstrong Teasdale LLP

(57) ABSTRACT

A method for aligning an inner shell of a turbine assembly with an outer shell of the turbine assembly along a transverse centerline of the turbine assembly perpendicular to an axial centerline of the turbine assembly includes positioning a first gib key assembly with respect to the transverse centerline. The first gib key assembly is connected to a first end surface of the inner shell to form a first groove within the first gib key assembly. A projection formed on a first end of the outer shell mateably engages the first groove formed within the first gib key assembly to align the inner shell with the outer shell along the transverse centerline.

20 Claims, 6 Drawing Sheets

METHOD AND ASSEMBLY FOR ALIGNING A TURBINE

BACKGROUND OF THE INVENTION

This invention relates generally to rotary machines and, more particularly, to a method and an assembly for aligning an inner shell of the rotary machine with an outer shell of the rotary machine.

Steam and gas turbines are used, among other purposes, to generate power for electric generators. Known steam turbines have a steam path that typically includes, in serial-flow relationship, a steam inlet, a turbine, and a steam outlet. Known gas turbines have a gas path which typically includes, in serial-flow relationship, an air intake (or inlet), a compressor, a combustor, a turbine, and a gas outlet (or exhaust nozzle). The compressor sections and the turbine sections each includes at least one row of circumferentially spaced rotating blades or buckets.

Turbine efficiency depends at least in part on controlling a radial clearance or gap between the rotor shaft and the surrounding casing. If the clearance is too large, steam or gas flow may leak through the radial clearance, thus decreasing turbine efficiency. Alternatively, if the clearance is too small, the rotating rotor shaft may undesirably contact the stationary packing ring during certain turbine operating conditions, thus adversely affecting turbine efficiency. Gas or steam leakage through the packing assembly represents a loss of efficiency and is generally undesirable.

To minimize leakage and prevent undesirable contact between rotating components and stationary components, the inner shell of the turbine is keyed axially and transversely to the outer shell of the turbine along the respective axial centerline and transverse centerline. Gib keys are generally positioned between the inner shell and the outer shell to properly align the inner shell with the outer shell during turbine assembly. Conventional gib keys typically have a generally circular disc shape and are fastened to the inner shell with a bolt. The dimensions of the packing head positioned within the inner shell, particularly a length of the packing head along the axial centerline, are limited by the circular disc shape of the conventional gib key. As a result of the dimensional limitations on the packing head, a sufficient number of packing rings are not positionable within the packing head to prevent or limit undesirable leakage, which negatively impacts turbine performance and efficiency.

BRIEF DESCRIPTION OF THE INVENTION

In one aspect, the present invention provides a method for aligning an inner shell with an outer shell of a turbine assembly along a transverse centerline perpendicular to an axial centerline of the turbine assembly. The method includes positioning a first gib key assembly with respect to the transverse centerline. The first gib key assembly is connected to a first end surface of the inner shell to form a first groove within the first gib key assembly. A projection formed on a first end of the outer shell is mateably engaged with the first groove formed within the first gib key assembly to align the inner shell with the outer shell along the transverse centerline.

In another aspect, the present invention provides a gib key assembly for a turbine assembly including an inner shell and an outer shell. The gib key assembly includes a first set of opposing gib keys connected to the inner shell. Each gib key includes a first plate forming at least one aperture therethrough. The first plate is connected to an end surface of the inner shell. The first plate transitions into a second plate, which extends substantially perpendicular with respect to the first plate. The second plate has a contact face that is positioned with respect to a transverse centerline of the turbine assembly.

In a further aspect, the present invention provides a steam turbine. The steam turbine includes a rotor shaft, which extends along an axial centerline of the steam turbine. A stationary inner shell is positioned about the rotor shaft and forms a chamber. A packing head is connected to the inner shell and positioned within the chamber. The packing head is circumferentially positioned about the rotor shaft and forms a plurality of channels. A packing ring is retained within each channel. A gib key assembly is connected at a first end surface of the inner shell and defines a groove. An outer shell is positioned about the inner shell and forms a projection positioned within the groove to align the inner shell with the outer shell along a transverse centerline of the turbine substantially perpendicular to an axial centerline of the turbine.

DETAILED DESCRIPTION OF THE INVENTION

The present invention provides a method and assembly for aligning an inner shell of a rotary machine, such as a steam turbine, with an outer shell of the rotary machine, wherein a packing head having an increased number of packing rings circumferentially positioned about a rotor shaft of the steam turbine is positionable within a chamber formed in the inner shell. The increased number of packing rings provides a tortuous path through which steam or fluid must flow to escape the steam turbine, thereby increasing the steam turbine efficiency.

The present invention is described below in reference to its application in connection with and operation of a steam turbine assembly. However, it will be obvious to those skilled in the art and guided by the teachings herein provided that the invention is likewise applicable to any combustion device or assembly including, without limitation, boilers, heaters and gas turbine engines, and may be applied to systems consuming natural gas, fuel, coal, oil or any solid, liquid or gaseous fuel.

Figure 1:
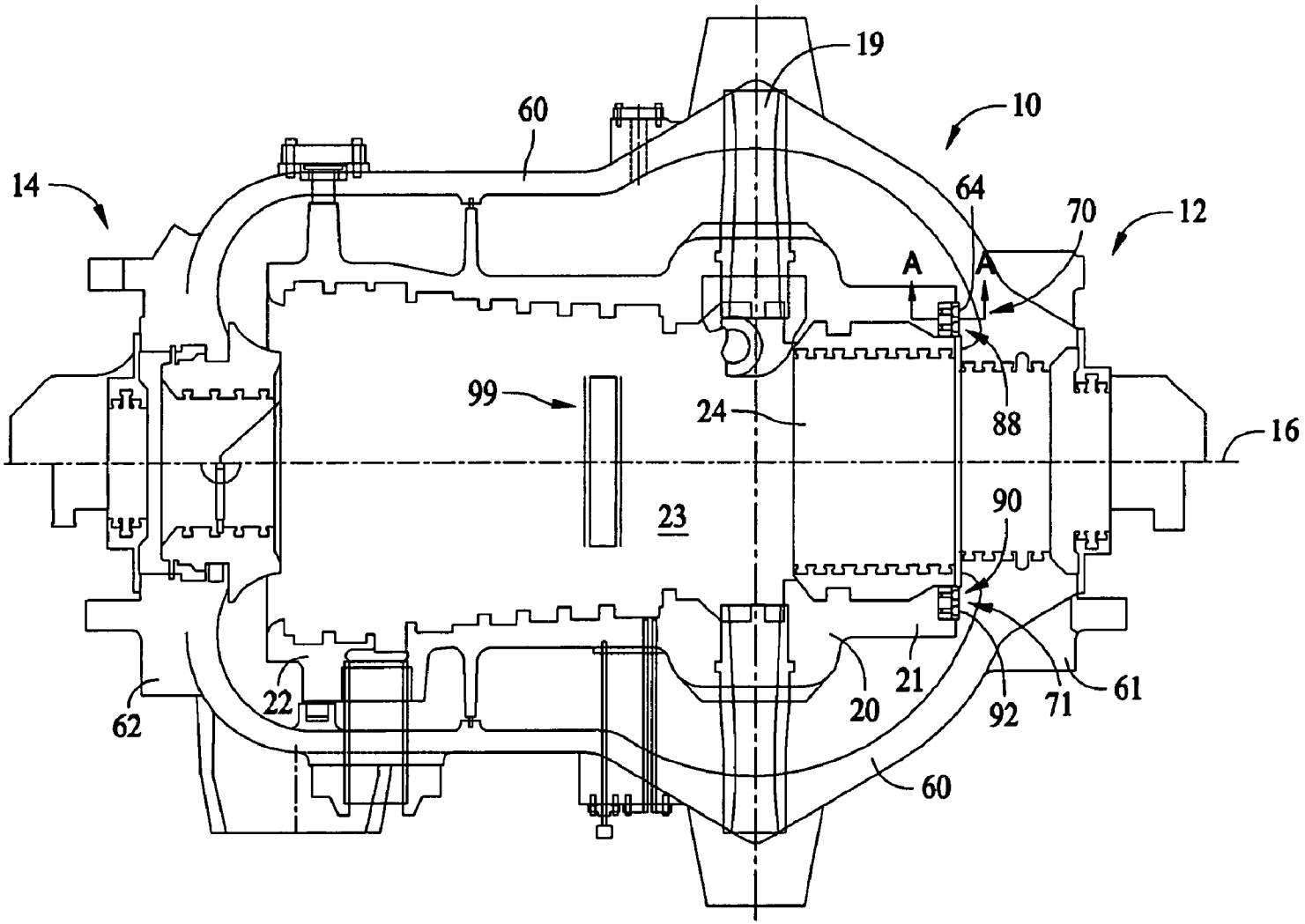
FIG. 1 is a schematic side view of an exemplary steam turbine, according to one embodiment of this invention.
Figure 2:
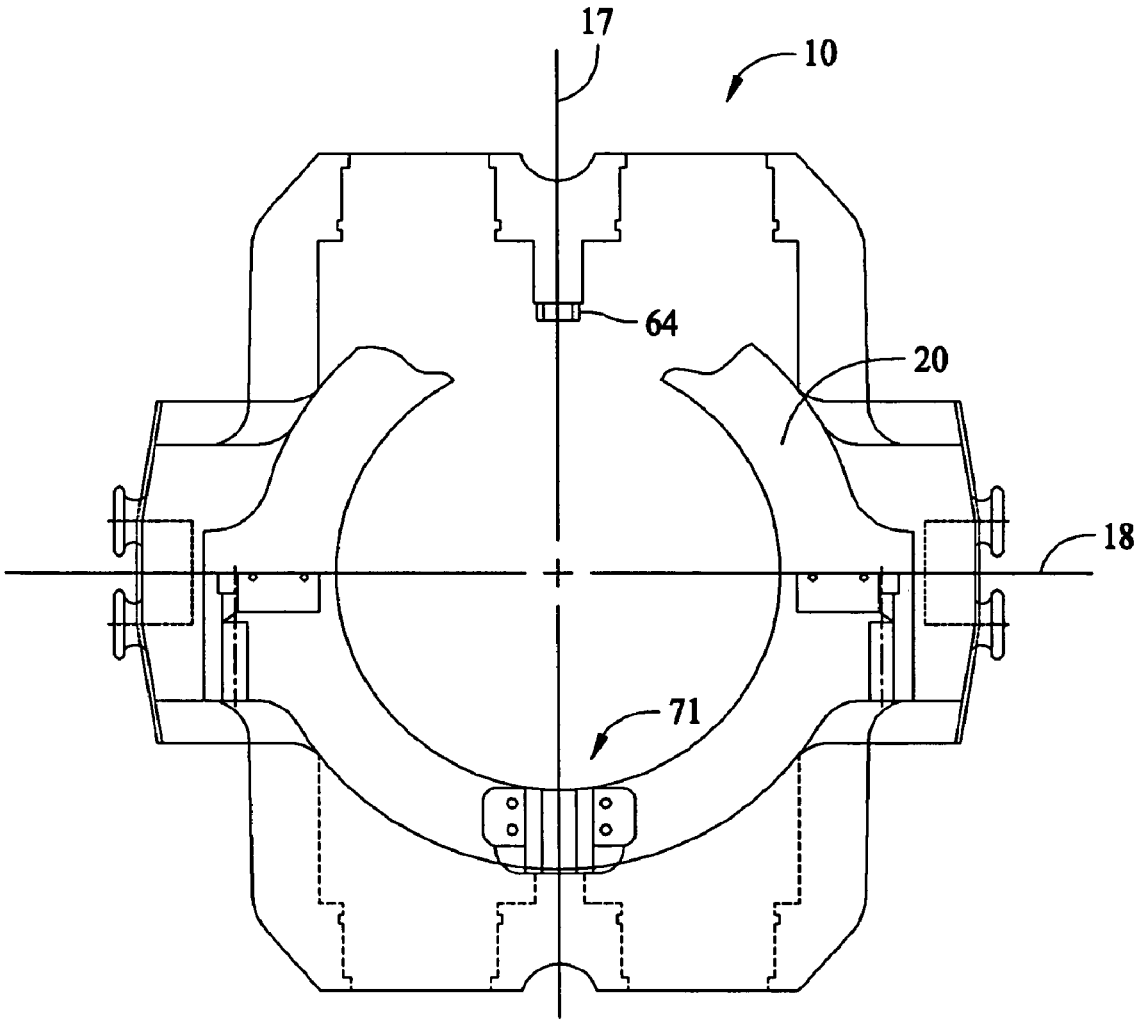
FIG. 2 is a schematic front view of an inner shell of the exemplary steam turbine shown in FIG. 1.

FIG. 1 is a schematic illustration of an exemplary steam turbine 10 having a first or generator end portion 12 and an opposing second or turbine end portion 14. Steam turbine 10 includes a rotor shaft (not shown in FIG. 1) that extends along at least a portion of an axial centerline 16 of steam turbine 10. Referring further to FIGS. 1 and 2, steam turbine 10 defines axial centerline 16, a vertical centerline 17 substantially perpendicular to axial centerline 16, and a transverse centerline 18 substantially perpendicular to axial centerline 16 and vertical centerline 17. During operation of steam turbine 10, high pressure steam from a steam source, such as a power boiler (not shown), enters steam turbine 10 at steam inlet 19 and exits at turbine end portion 14, as shown in FIG. 1.

Figure 3:
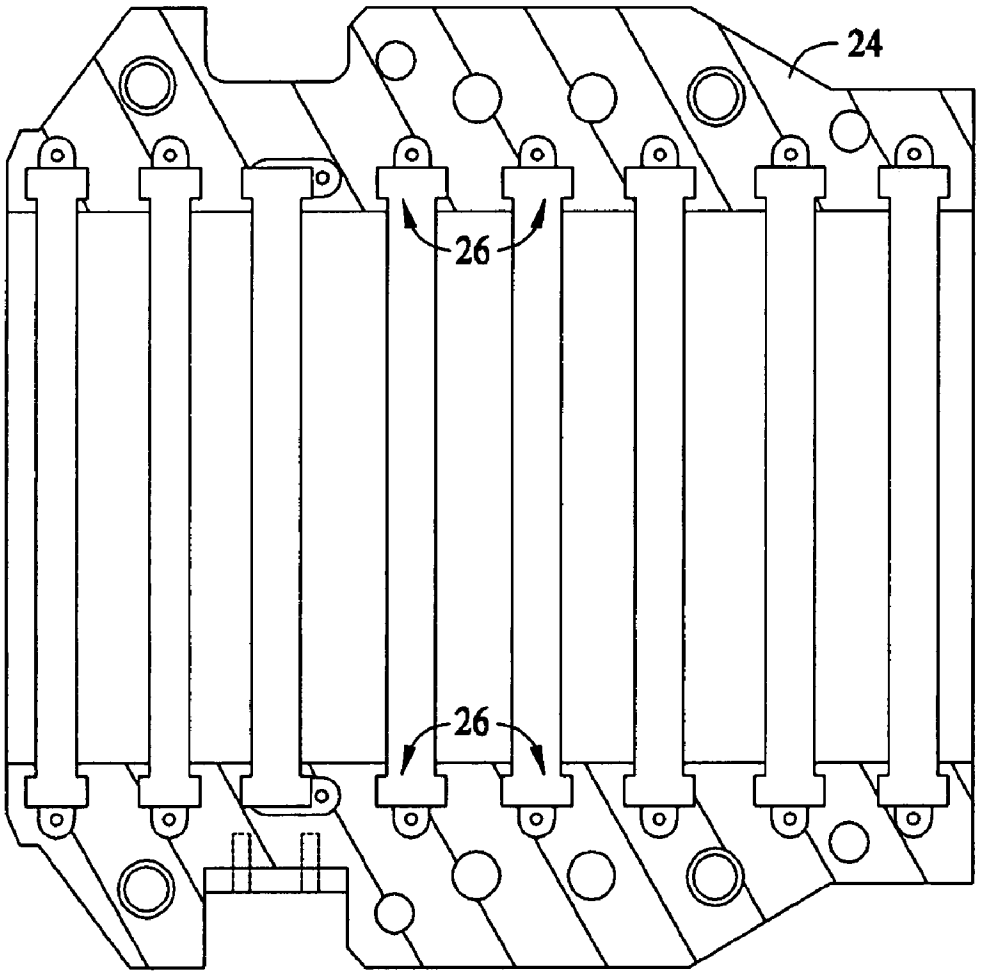
FIG. 3 is an enlarged sectional view of a packing head for the steam turbine shown in FIG. 1.

A stationary inner shell 20 is positioned about the rotor shaft and extends along axial centerline 16. Inner shell 20 includes a generator end surface 21 and an opposing turbine end surface 22. Inner shell forms a chamber 23 within which the rotor shaft is positioned. As shown in FIG. 1, a packing head 24 is connected to inner shell 20 and positioned within chamber 23. Packing head 24 is circumferentially positioned about the rotor shaft and axial centerline 16. Referring further to FIG. 3, packing head 24 includes a plurality of channels 26. In one embodiment, packing head 24 includes eight channels 26 formed along an axial length of packing head 24. Referring further to FIG. 3, each channel 26 extends circumferentially about axial centerline 16 and is dimensioned to receive a packing ring 28. Each packing ring 28 is retained in a corresponding channel 26 defined in packing head 24. In alternative embodiments, packing head 24 includes any suitable number of channels 26.

Figure 4:
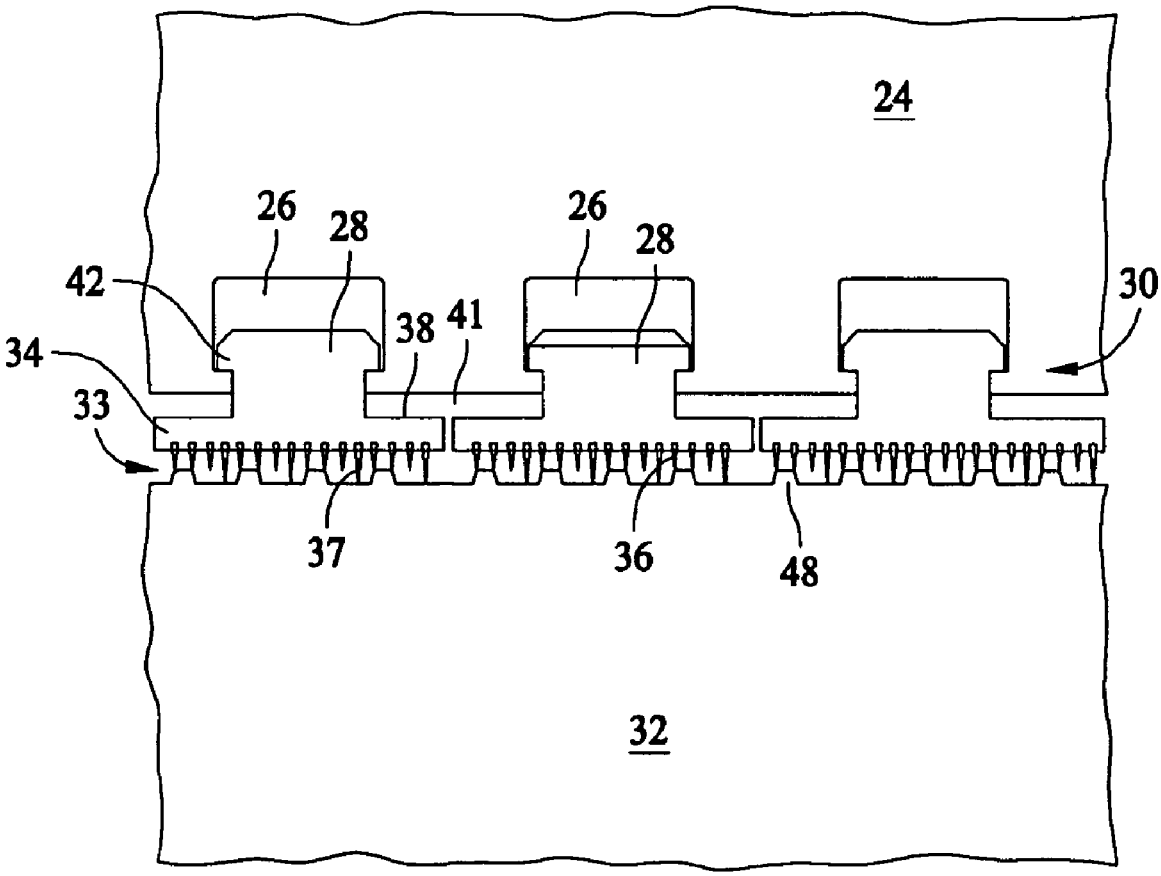
FIG. 4 shows a section of a seal assembly for the steam turbine shown in FIG. 1, according to one embodiment of this invention.
Figure 5:
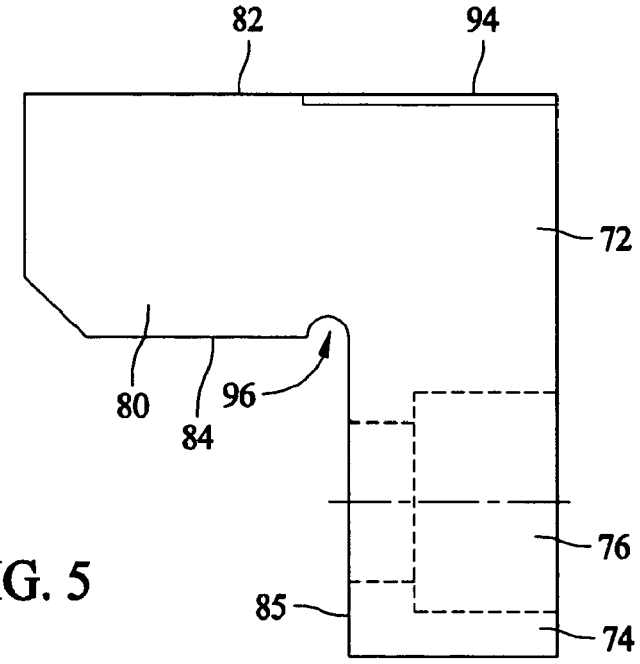
FIG. 5 is a top view of a gib key, according to one embodiment of this invention.
Figure 6:
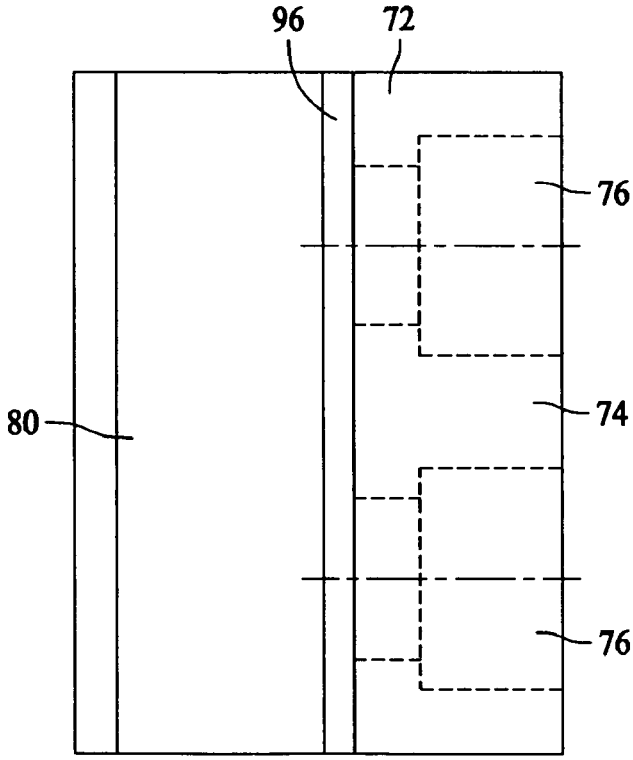
FIG. 6 is a side view of the gib key shown in FIG. 5.
Figure 7:
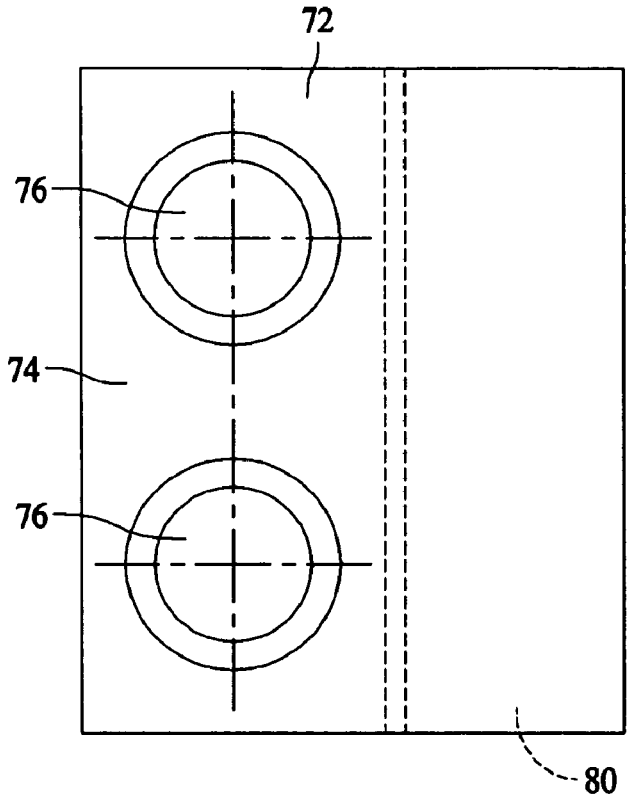
FIG. 7 is a front view of the gib key shown in FIG. 5.

In one embodiment, steam turbine 10 includes a seal assembly 30, as shown in FIG. 4. In FIG. 4, only a portion of a rotor shaft 32 and a portion of packing head 24 are illustrated. A radial clearance 33 is defined between rotor shaft 32 and packing head 24 and/or packing rings 28. Each packing ring 28 includes an inner ring portion 34 having teeth 36 extending from a radially inner surface 37 of inner ring portion 34, and a radially outer surface 38 that facilitates controlling radial clearance or gap 33 by contacting a radial surface 41 of packing head 24. Each packing ring 28 also includes an outer ring portion 42 that is positioned within channel 26.

Packing ring 28 includes a plurality of teeth 36 positioned in opposition to a plurality of rotor shaft circumferential projections 48 extending outward from rotor shaft 32. A positive force may force fluid flow between the multiple restrictions formed within radial clearance 33 defined at least partially between teeth 36 and rotor shaft 32. More specifically, radial clearance 33, the number and relative sharpness of teeth 36, the number of rotor shaft circumferential projections 48 and/or the operating conditions, including pressure and density, are factors that determine the amount of leakage flow. Alternately, other geometrical arrangements can also used to provide multiple or single leakage restrictions.

As shown in FIG. 1, steam turbine 10 includes an outer shell 60 that is positioned about inner shell 20. Outer shell 60 includes a first or generator end surface 61 and an opposing second or turbine end surface 62 generally corresponding with generator end surface 21 and turbine end surface 22 of inner shell 20, respectively. In one embodiment, inner shell 20 is aligned with outer shell 60 along transverse centerline 18 of steam turbine 10 by mateably engaging a projection 64 formed at generator end surface 61 with at least one gib key assembly 70 connected to inner shell 20 at generator end surface 21. Referring further to FIG. 1, in one embodiment, steam turbine 10 includes a first gib key assembly 70 connected to inner shell 20 and a second gib key assembly 71, the same or similar to gib key assembly 70, connected to inner shell 20 and radially positioned on generator end surface 21 at about 180° with respect to first gib key assembly 70.

Referring to FIGS. 5-8, gib key assembly 70 and/or gib key assembly 71 includes opposing gib keys 72 connectable to generator end surface 21 of inner shell 20. Each gib key 72 includes a first plate 74 that forms at least one aperture 76 therethrough. In one embodiment, two counter-sunk apertures 76 are formed through plate 74, as shown in FIGS. 5-8, to properly position a fastener 78, such as bolt, within aperture 76. It is apparent to those skilled in the art and guided by the teachings herein provided that any suitable fastener can be positioned within aperture 76 and threadedly connectable to inner shell 20 to connect each gib key 72 to inner shell 20. Plate 74 transitions into a second plate 80 that extends substantially perpendicular with respect to plate 74. In one embodiment, plate 80 has a contact face 82 that is positioned with respect to transverse axis 18 and an outer surface 84 positioned substantially perpendicular with respect to an outer surface 85 of plate 74.

Figure 8:
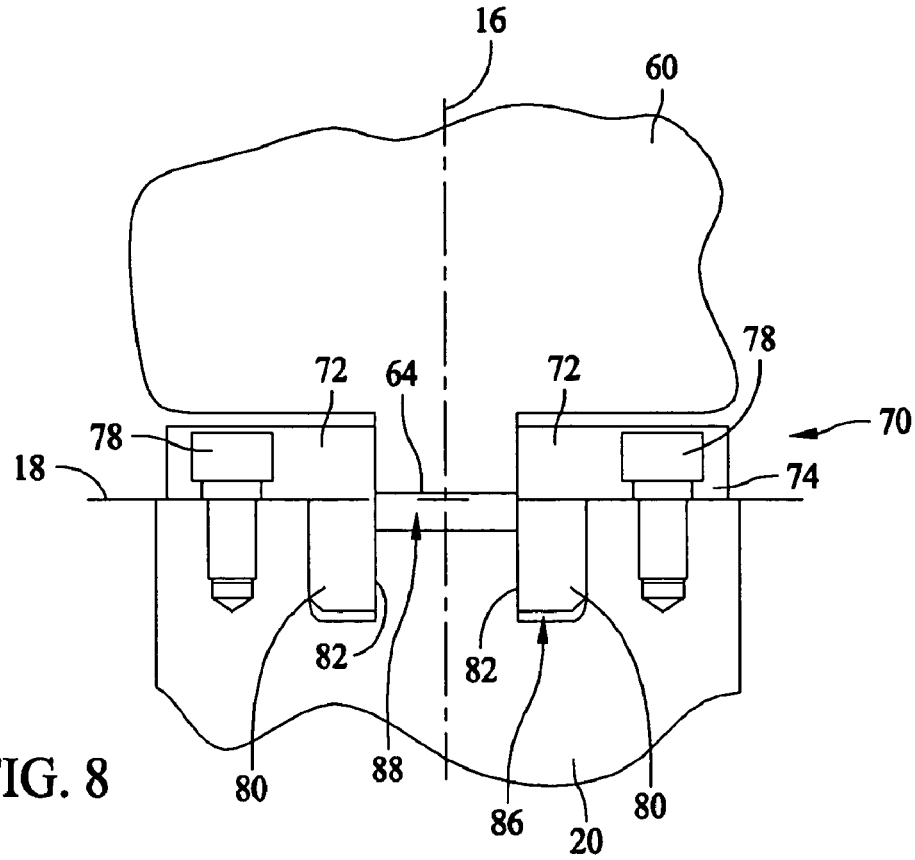
FIG. 8 is a sectional view of a gib key assembly taken along sectional line A-A shown in FIG. 1, according to one embodiment of this invention.

For example, as shown in FIG. 8, at least a portion of plate 80 extends into a void 86 formed in generator end surface 21 of inner shell 20 such that a length of contact face 82 of each opposing gib key 72 is positioned parallel with respect to transverse centerline 18. Further, a depth of contact face 82 of each opposing gib key 72 is positioned parallel with respect to axial centerline 16. With opposing gib keys 72 in a connected configuration, gib key assembly 70 forms a groove 88. Projection 64 is positioned within groove 88 and between opposing gib keys 72 to maintain inner shell 20 aligned with outer shell 60 along transverse centerline 18. In one embodiment, second gib key assembly 71 is connected at generator end surface 21 of inner shell 20 and defines a second groove 90 radially offset with respect to groove 88, for example positioned along vertical centerline 17. A second projection 92 formed on generator end surface 61 of outer shell 60 is positioned within groove 90 and between opposing gib keys 72 of gib key assembly 71.

In one embodiment, a suitable coating material, such as a stellite coating 94 or a nitride coating, is applied to at least a portion of contact face 82, for example at an edge of contact face 82. Any suitable coating material known to those skilled in the art and guided by the teachings herein provided may be applied to at least a portion of contact face 82. Stellite coating 94, as shown in FIG. 8, is applied to contact face 82 to harden contact face 82. Projection 64 is securely positioned within groove 88 and contacts stellite coating 94. Further, gib key 72 includes a groove 96 formed along at least a portion of a length of gib key 72 at a transition line or boundary between first plate 74 and second plate 80.

Gib key assemblies 70 and/or 71 allow an increased number of channels 26 to be formed along the length of packing head 24 compared to conventional packing heads. Specifically, in one embodiment, the increased area within chamber 23 as a result of gib key assembly 70 and/or 71 of the present invention allows for the formation of eight channels 26 within packing head 24, whereas conventional packing heads including generally circular disc-shaped gib keys have a length suitable for formation of a maximum of five channels. With the increased number of packing rings 28 positioned within cooperating channels 26, steam leakage within steam turbine 10, which results in a decrease in steam turbine efficiency, is greatly reduced.

In one embodiment, a method for aligning inner shell 20 of steam turbine 10 with outer shell 60 of steam turbine 10 along transverse centerline 18 includes positioning or locating first gib key assembly 70 with respect to transverse centerline 18. Gib key assembly 70 is connected to generator end surface 21 of inner shell 20 to form groove 88 within gib key assembly 70 along transverse centerline 18. In one embodiment, at least a portion of second plate 80 of each gib key 72 is inserted into void 86 formed in generator end surface 21. As shown in FIG. 8, projection 64 formed on generator end surface 61 of outer shell 60 is mateably engageable with groove 88 formed within gib key assembly 70 to align inner shell 20 with outer shell 60 along transverse centerline 18. In one embodiment, a depth of contact face 82 formed in each gib key 72 is positioned parallel with respect to axial centerline 16 and a length of contact face 82 formed in each gib key 72 is positioned parallel with respect to vertical centerline 17 (not shown in FIG. 8). Further, inner shell 20 can be aligned with outer shell 60 along axial centerline 16 using a suitable axial gib key assembly 99.

Alternatively, or additionally, a second gib key assembly 71 is positioned or located with respect to axial centerline 16 and transverse centerline 18. In one embodiment, second gib key assembly 71 is positioned on generator end surface 21 and radially opposes first gib key assembly 70, for example positioned along vertical centerline 17. Second gib key assembly 71 is connected to generator end surface 21 of inner shell 20 to form second groove 90 within second gib key assembly 71. In one embodiment, with gib key assembly 71 connected to inner shell 20, at least a portion of second plate 80 of each gib key 72 is positioned within a second void formed in generator end surface 21, the same or similar to void 86 shown in FIG. 8. A second projection 92 formed on generator end surface 61 of outer shell 60 and vertically opposing first projection 64 is mateably engageable with second groove 90 to align inner shell 20 with outer shell 60 along transverse centerline 18.

The above-described method and assembly provide a steam turbine with increased energy efficiency. More specifically, the method and assembly of the present invention aligns an inner shell of the steam turbine with an outer shell of the steam turbine along a transverse centerline of the steam turbine, while providing an increased area within the chamber formed by the inner shell. A packing head having an increased number of packing rings circumferentially positioned about the rotor shaft of the steam turbine is positioned within the chamber. The increased number of packing rings positioned along a length of the packing head provides a reduction in steam leakage from within the steam turbine, resulting in an increase in steam turbine efficiency.

Exemplary embodiments of a gib key assembly are described above in detail. The methods and assemblies are not limited to the specific embodiments described herein or to the specific arrangements assembled, but rather, the methods and assemblies may be utilized independently and separately from other methods and assemblies described herein. For example, the gib key assembly described above may also be used in combination with other turbines.

While the invention has been described in terms of various specific embodiments, those skilled in the art will recognize that the invention can be practiced with modification within the spirit and scope of the claims.

What is claimed is:

1. A method for aligning an inner shell of a turbine assembly with an outer shell of the turbine assembly along a transverse centerline of the turbine assembly perpendicular to an axial centerline of the turbine assembly, the method comprises:

positioning a first gib key assembly with respect to the transverse centerline;

connecting the first gib key assembly to a first end surface of the inner shell to form a first groove within the first gib key assembly;

mateably engaging a projection formed on a first end of the outer shell with the first groove formed within the first gib key assembly to align the inner shell with the outer shell along the transverse centerline.

2. A method in accordance with claim 1 further comprising positioning a contact face of each gib key of the first gib assembly parallel with respect to the transverse centerline.

3. A method in accordance with claim 1 further comprising inserting at least a portion of a second plate of each gib key of the first gib key assembly into a void formed in the first end surface.

4. A method in accordance with claim 1 wherein connecting each gib key to a first end surface of the inner shell further comprises forming the groove along the transverse centerline.

5. A method in accordance with claim 1 further comprising:

positioning a second gib key assembly with respect to the transverse centerline and radially opposing the first gib key assembly;

connecting the second gib key assembly to the first end surface of the inner shell to form a second groove within the second gib key assembly;

mateably engaging a second projection formed on the first end of the outer shell with the second groove to align the inner shell with the outer shell along the axial centerline and the transverse centerline.

6. A method in accordance with claim 5 further comprising positioning a contact face of each gib key of the second gib assembly parallel with respect to the transverse centerline to form the second groove along the transverse centerline.

7. A method in accordance with claim 5 further comprising inserting at least a portion of a second plate of each gib key of the second gib key assembly into a void formed in the first end surface.

8. A method in accordance with claim 1 further comprising positioning the inner shell with the outer shell along the transverse centerline.

9. A gib key assembly for a turbine assembly including an inner shell and an outer shell, said gib key assembly comprising:

a first set of opposing gib keys connected to said inner shell, each gib key of said opposing gib keys comprising:

a first plate forming at least one aperture therethrough, said first plate connected to an end surface of said inner shell;

said first plate transitioning into a second plate, said second plate extending substantially perpendicular with respect to said first plate and having a contact face positioned with respect to a transverse centerline of said turbine assembly.

10. A gib key assembly in accordance with claim 9 further comprising a coating material applied to at least a portion of said contact face.

11. A gib key assembly in accordance with claim 9 further comprising a groove formed along at least a portion of a length of each said gib key at a transition line between said first plate and said second plate.

12. A gib key assembly in accordance with claim 9 wherein said second plate extends into a void formed in said end surface.

13. A gib key assembly in accordance with claim 9 further comprising a projection formed in an end surface of said outer shell, said projection positioned between said two opposing gib keys to maintain said inner shell aligned with said outer shell along said transverse centerline.

14. A gib key assembly in accordance with claim 9 wherein an outer surface of said second plate is positioned substantially perpendicular with respect to an outer surface of said first plate.

15. A gib key assembly in accordance with claim 9 further comprising a second set of opposing gib keys connected to said inner shell, said second set of opposing gib keys radially positioned on said end surface at about 180° with respect to said first set of opposing gib keys.

16. A steam turbine comprising:

a rotor shaft extending along an axial centerline of said steam turbine;

a stationary inner shell positioned about said rotor shaft and forming a chamber;

a packing head connected to said inner shell and positioned within said chamber, said packing head circumferentially positioned about said rotor shaft and forming a plurality of channels;

a packing ring retained within each channel of said plurality of channels;

a gib key assembly connected at a first end surface of said inner shell and defining a groove;

an outer shell positioned about said inner shell and forming a projection positioned within said groove to align said inner shell with said outer shell along a transverse centerline of said turbine substantially perpendicular to said axial centerline.

17. A steam turbine in accordance with claim 16 wherein a radial clearance is defined between said rotor shaft and said packing head.

18. A steam turbine in accordance with claim 16 wherein said packing head forms at least six channels.

19. A steam turbine in accordance with claim 16 further comprising a second gib key assembly connected at said first end surface and defining a second groove radially offset with respect to said first groove.

20. A steam turbine in accordance with claim 19 further comprising a second projection formed on said outer shell, said second projection positioned within said second groove.

* * * * *